United States Patent [19]

Kubota et al.

[11] 4,163,130

[45] Jul. 31, 1979

[54] VACUUM INTERRUPTER WITH PRESSURE MONITORING MEANS

[75] Inventors: Yoshiyuki Kubota; Yukio Kurosawa; Hiroyuki Sugawara, all of Hitachi, Japan

[73] Assignee: Hitachi, Ltd., Japan

[21] Appl. No.: 708,098

[22] Filed: Jul. 23, 1976

[30] Foreign Application Priority Data

Jul. 25, 1975 [JP] Japan ..... 50-90087
Dec. 3, 1975 [JP] Japan ..... 50/142940

[51] Int. Cl.[2] ..... H01H 33/66

[52] U.S. Cl. ..... 200/144 B; 324/122; 361/120; 313/187

[58] Field of Search ..... 200/144 B; 361/120; 313/187, 160, 161; 315/108; 324/33, 36, 122

[56] References Cited

U.S. PATENT DOCUMENTS

| | | | |
|---|---|---|---|
| 3,371,854 | 3/1968 | Herb | 315/108 |
| 3,403,297 | 9/1968 | Crouch | 361/120 |
| 3,411,035 | 11/1968 | Necker et al. | 313/187 |
| 3,448,337 | 6/1969 | Kawiecki | 361/120 |
| 3,543,085 | 11/1970 | Pflanz et al. | 315/108 |
| 3,641,359 | 2/1972 | McCarty | 361/120 |

FOREIGN PATENT DOCUMENTS 2002685 3/1971 Fed. Rep. of Germany ..... 200/144 B

*Primary Examiner*—Robert S. Macon
*Attorney, Agent, or Firm*—Craig and Antonelli

[57] ABSTRACT

A vacuum interrupter with pressure monitoring means wherein a pair of separable electrodes are arranged within a highly evacuated envelope and are connected to a high voltage circuit provided with a vacuum pressure detector element which has a pair of detector electrodes insulated from each other and serving to detect the pressure of the vacuum within the evacuated envelope. The vacuum pressure detector element has a voltage applied thereto in such a manner that one of the detector electrodes is conductively connected to the one end of the evacuated envelope to which the high voltage circuit is connected and the other detector electrode is connected to ground potential through a series connection member consisting of different sorts of voltage allotment elements which are selected from a resistance, an inductance, and a capacitor and whose voltage allotment ratio varies in dependence on frequency. A vacuum pressure detector means detects the operation of the vacuum pressure detector element.

14 Claims, 11 Drawing Figures

VACUUM INTERRUPTER WITH PRESSURE MONITORING MEANS

BACKGROUND OF THE INVENTION

1. Field of the Invention

This invention relates to a vacuum interrupter for use in a high voltage circuit. More particularly, it relates to a vacuum interrupter including an evacuated envelope equipped with pressure monitoring means having a vacuum pressure detector element for monitoring the internal pressure of the evacuated envelope at all times and which applies to the vacuum pressure detector element a voltage obtained by dividing the voltage of the high voltage circuit as applied to the vacuum interrupter.

2. Description of the Prior Art

A vacuum interrupter comprises an envelope held at a high vacuum and a pair of relatively movable electrodes located within the envelope. When the interrupter is in the closed position, the pair of electrodes contact each other to conduct a current. The interrupting operation is effected by separating the electrodes. An arc produced between the electrodes at the time of separation is extinguished by employing an arc diffusing action in the vacuum and is prevented from reigniting by the high dielectric strength characteristic of the high vacuum.

In order to extinguish the arc and prevent it from reigniting, it is important to maintain the pressure inside the envelope below a predetermined value. Accordingly, some means must be provided for the vacuum interrupter to monitor the internal pressure of the envelope. Means for monitoring the vacuum pressure inside the envelope of the vacuum interrupter at all times is disclosed in, for example, the specification of U.S. Pat. No. 3,403,297.

This pressure monitoring means for the vacuum interrupter is so constructed that, when the vacuum interrupter is in the closed state, a voltage is applied from a separate power source between an intermediate metal shield arranged within the envelope and either electrode of a pair of separable electrodes for interrupting the current. More specifically, when the pressure inside the envelope rises, the generation of a glow discharge due to the voltage applied between the electrodes is detected to issue an alarm. Besides, in order to avoid any damage of the vacuum interrupter, a current-responsive detector is operated by the glow discharge current so as to prevent the vacuum interrupter from being opened.

On the other hand, when the pressure inside the envelope is normal, the intermediate metal shield is held at a floating potential in order not to interfere with or undesirably affect the interrupting operation. Therefore, the voltage applied from the separate power source is removed prior to the start of the interrupting operation, and the monitoring means is electrically detached. Thus, the pressure monitoring means for the vacuum interrupter as described above is undesirable in that it requires a separate power source, and has a complicated circuit arrangement for detaching the power source prior to the start of the interrupting operation of the vacuum interrupter.

Another example of a method of pressure monitoring means in a vacuum interrupter of this type is one known as the magnetron method. According to this pressure monitoring method, a pair of pressure detector electrodes are insulated and constitute a vacuum pressure detector element which communicates with the envelope of the vacuum interrupter. A magnetic field is applied in the area between the electrodes, while an electric field crossing the magnetic field is provided. Thus, any residual gas inside the envelope is ionized, and an ionic current flows between the pair of electrodes. The ionic current is measured to indicate the residual gas pressure. Since, however, such a vacuum interrupter is connected to the high voltage circuit, the power source for applying the voltage between the electrodes of the vacuum pressure detector element must be electrically insulated by the use of, for example, an insulating transformer.

SUMMARY OF THE INVENTION

It is an object of this invention to provide a vacuum interrupter with pressure monitoring means which can supply a voltage between a pair of vacuum pressure detector electrodes forming part of a vacuum pressure detector by dividing the voltage of the high voltage circuit which is applied to the vacuum interrupter.

Another object of this invention is to provide a vacuum interrupter with pressure monitoring means which can eliminate influences of a charging current flowing due to a stray capacitance existing between a pair of vacuum pressure detector electrodes of a vacuum pressure detector mounted on the envelope of the vacuum interrupter.

In order to accomplish these objects, this invention consists in a vacuum interrupter with pressure monitoring means wherein a vacuum pressure detector having a pair of vacuum pressure detector electrodes insulated from each other is disposed in a container whose one end communicates with an envelope of the vacuum interrupter to be connected to a high voltage circuit and whose other end is tightly closed. One end of one vacuum pressure detector electrode is conductively connected to the envelope, while a series connection member which consists of at least two voltage allotment elements connected in series is disposed between the end of the other vacuum pressure detector electrode and ground potential. The two voltage allotment elements are different sorts of elements which are selected from a resistance, an inductance, and a capacitor and whose voltage allotment ratio varies depending upon frequency. Vacuum pressure detector means is provided which is connected in parallel with a part of the series connection member, whereby a voltage is applied to the vacuum pressure detector element through the series connection member and the variation of the voltage allotment ratio of the series connection member which is caused by a discharge current flowing between the vacuum pressure detector electrodes in response to a pressure rise in the envelope is detected by the vacuum pressure detector means.

DESCRIPTION OF THE PREFERRED EMBODIMENTS

Figure 1:
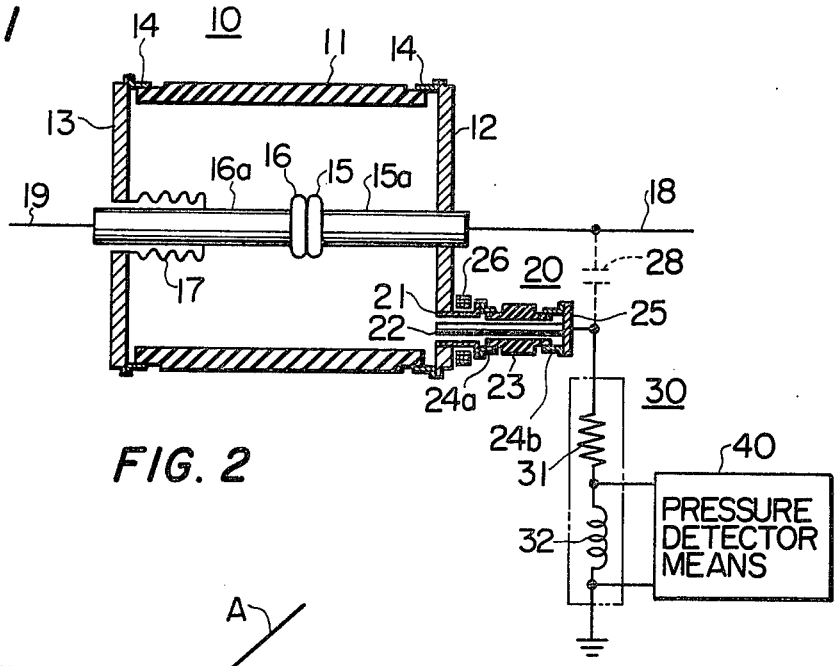
FIG. 1 is a schematic view of an embodiment of this invention at the time when the vacuum interrupter is in the closed state.

FIG. 1 is a schematic view of an embodiment of this invention at the time when the vacuum interrupter is connected to a high voltage circuit and is in the closed state.

Referring to the figure the vacuum interrupter comprises a sealed envelope 10 which consists of a suitable insulating cylinder 11 and a pair of metallic end plates 12 and 13 closing both ends of the insulating cylinder and which is evacuated to a high vacuum. Securing the end plates 12, 13 to the insulating cylinder 11 are metallic flanges 14, which seal the respective elements to maintain the envelope 10 at high vacuum. A pair of separable, stationary and movable electrodes 15 and 16 are arranged within the sealed envelope 10, and they are shown in closed position.

The stationary electrode 15 is secured to one end of a stationary electrode holder **15*a*, the other end of which is secured to the end plate 12. The movable electrode 16 is secured to one end of a movable electrode holder 16*a*, the other end of which protrudes through an opening of the end plate 13 so as to be capable of driving the movable electrode 16. A metallic bellows 17 is secured between the movable electrode holder 16*a* and the end plate 13 so as to allow the movable electrode holder 16*a* to move without spoiling the airtightness of the sealed envelope 10. The stationary electrode holder 15*a* is connected to a power supply side line 18, while the movable electrode holder 16*a* is connected to a load side line 19. The movable electrode holder 16*a* is mechanically coupled with conventional operating means (not shown) to selectively separate the movable electrode 16 from the stationary electrode 15** in the well-known manner.

Under the closed state illustrated, a current flows between the power supply side line 18 and the load side line 19 via the parts **15*a*, 15, 16, and 16*a* of the vacuum valve. The circuit interrupting operation is effected by driving the movable electrode holder 16*a* leftwards and separating the movable electrode 16 from the stationary electrode 15** by means of the operating device (not shown). This results in the generation of an arc between the electrodes. In case of an a.c. circuit, the arc is extinguished at the first current zero point by the arc diffusing action of the vacuum.

In accordance with the present invention, a vacuum pressure detector element 20 is mounted on the end plate 12 forming part of the sealed envelope 10. The vacuum pressure detector element 20 includes a pair of vacuum pressure detector electrodes 21 and 22 arranged concentrically and in opposition to each other. The electrodes 21 and 22 are supported in electrically insulated relationship by a support arrangement including an insulating cylinder 23, metallic flanges **24*a* and 24*b* are secured to the respective ends of the insulating cylinder 23 and an end plate 25. The flange 24*a* secures one end of the insulating cylinder 23 to the vacuum pressure detector electrode 21, while the flange 24*b* couples the end plate 25 to the other end of the insulating cylinder 23. The vacuum pressure detector electrode 22 is supported on the end plate 25**.

The vacuum pressure detector electrode 21 is secured to the end plate 12 to communicate with the sealed envelope 10 of the vacuum interrupter and to be conductively connected to the power supply side line 18. The vacuum pressure detector electrode 22 is secured to the end plate 25, which serves to maintain the airtightness of the device as well as a conductive contact for the electrode.

Magnetic field generating means 26, such as a permanent magnet or an electromagnetic coil, is provided in surrounding relationship at the outer peripheral part of the vacuum pressure detector electrode 21 to generate a magnetic field in the space between electrodes 21 and 22 in an axial direction. The end plate 25 and the vacuum pressure detector electrode 22 secured thereto are connected to ground potential through a connection member 30 which consists of voltage allotment elements, i.e., a resistance 31 and an inductance 32, connected in series. Input terminals of vacuum pressure detector means 40 are connected across terminals of the inductance 32.

A capacitor 28 indicated by dotted lines represents the stray capacitance between the power supply line 18 and the vacuum pressure detector electrode 22, and therefore, is included as a component of the vacuum pressure detector element 20.

As described above, the vacuum interrupter with pressure monitoring means comprises the sealed envelope 10, the vacuum pressure detector element 20, the series connection member 30 composed of the voltage allotment elements, and the vacuum pressure detector means 40.

Figure 2:
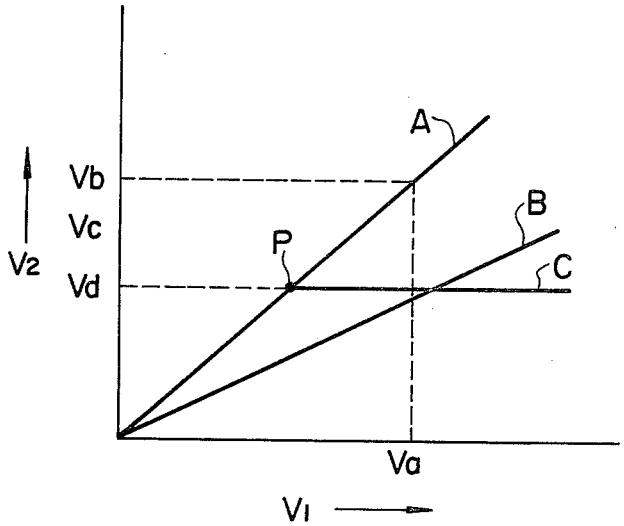
FIG. 2 is a characteristic diagram showing the relationship between the voltage-to-ground of a power supply side line in FIG. 1 and the voltage applied to a vacuum pressure detector element.

The principle of the present invention will now be described with reference to FIG. 2 as well as FIG. 1. A voltage is applied from the power supply side line 18 to the vacuum pressure detector element 20 via the end plate 12 of envelope 10 so that a radial electrostatic field is produced between electrodes 21 and 22 crossing the magnetic field generated by coil 26. FIG. 2 illustrates the relationship between the voltage-to-ground $V_1$ of the power supply side line 18 and the voltage $V_2$ which is applied between the detector electrodes 21 and 22 of the vacuum pressure detector element 20.

As stated previously, the vacuum pressure detector electrode 21 is conductively connected to the power supply side line 18 through the end plate 12. Therefore, the stray capacitance 28 exists between the detector electrodes 21 and 22. For this reason, the stray capacitance 28 and the series connection member 30 composed of the voltage allotment elements are effectively connected in series between the power supply side line 18 and ground potential. In consequence, a voltage divider is formed by these elements. As indicated by a curve A, accordingly, the voltage $V_2$ applied between the vacuum pressure detector electrodes 21 and 22 increases in proportion to the voltage-to-ground $V_1$ of the power supply side line.

Assuming the voltage-to-ground of the power supply side line to be $V_a$, a voltage $V_b$ is applied between the vacuum pressure detector electrodes 21 and 22. When the allowable breakdown voltage of the vacuum pressure measuring element 20 is a value $V_c$ smaller than the value $V_b$, a capacitor (not shown) is in parallel with the stray capacitance 28 between the vacuum pressure detector electrodes 21 and 22, whereby the voltage $V_2$ can be limited to a voltage $V_d$ lower than the breakdown voltage $V_c$ as indicated by a curve B.

Figure 3:
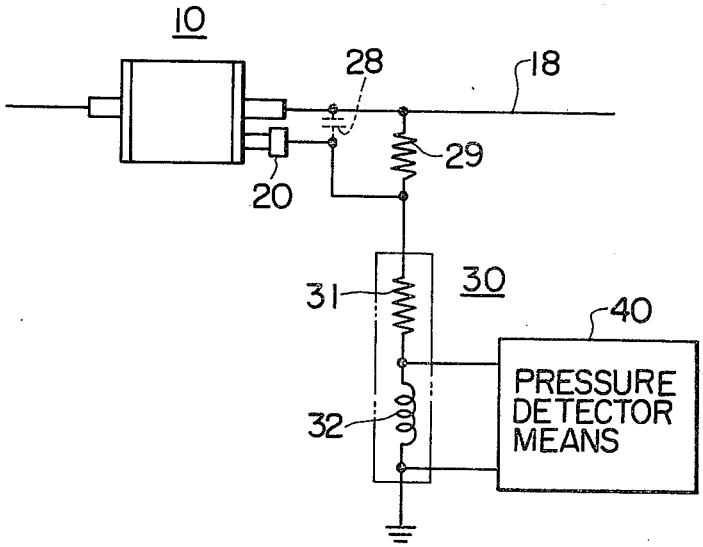
FIG. 3 is a schematic view of another embodiment of this invention.

Regarding the method for limiting the voltage $V_2$ below the permissible voltage $V_c$ of the vacuum pressure detector element 20, the capacitor can be replaced by a voltage-nonlinear resistance element 29 which, as shown in FIG. 3, is connected between the power supply side line 18 and the series connection member 30 composed of the voltage allotment elements. In this case, the voltage-nonlinear resistance element has a characteristic represented by the curve C shown in FIG. 2, which is well known as the characteristic of the element of the specified type and in which the voltage to be applied to the vacuum pressure detector element is refracted at a point P on the curve A for obtaining the voltage $V_d$.

As explained above, the voltage obtained by dividing the power supply side line voltage can be applied between the vacuum pressure detector electrodes 21 and 22 of the vacuum pressure detector element 20.

The operation of the pressure-monitoring means will now be described with reference to FIG. 4 as well as FIG. 1.

Figure 4:
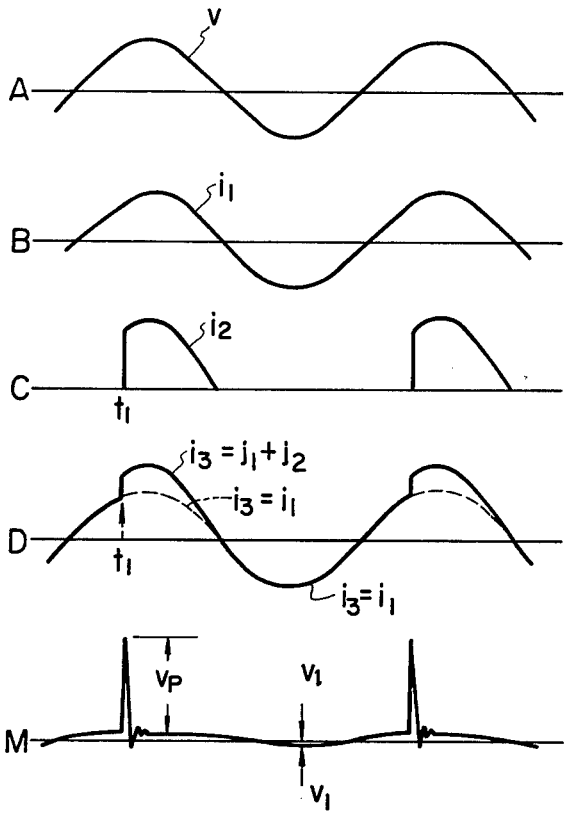
FIG. 4 is a waveform diagram for explaining the operation of the apparatus of this invention.

FIG. 4 shows waveforms at various parts of the vacuum interrupter illustrated in FIG. 1. In the figure, the waveform A represents the voltage-to-ground v of the power supply side line 18 in FIG. 1. The waveform B represents the charging current $i_1$ flowing through the stray capacitance 28. The waveform C represents the ionic discharge current $i_2$ of the pressure detector element 20. The waveform D represents the current $i_3$ flowing through the series connection member 30 composed of the resistance 31 and the inductance 32, and the waveform M represents the terminal voltage $v_l$ of the inductance 32.

Setting is so made that, if the pressure inside the sealed envelope 10 of the vacuum interrupter is below $10^{-6}$ Torr, no ionic current will be induced between the pressure detector electrodes 21 and 22 by the foregoing applied voltage obtained by dividing the voltage-to-ground of the power supply side line. As shown by the waveform D, however, since the current $i_2$ is zero under these conditions, the charging current $i_1$ flowing through the stray capacitance 28 flows as $i_3=i_1$ through the resistance 31 and the inductance 32 of the series connection member 30. As a result, the terminal voltage $v_l$ of the inductance 32 becomes $v_1$ as shown in waveform M, and it is applied as an input voltage signal to the vacuum pressure detector means 40. Since, however, the operation detecting level of the detector means 40 is set to be above the very small voltage $v_1$, the detector means 40 does not operate.

When the pressure inside the sealed envelope 10 of the vacuum interrupter rises up to the order of $10^{-4}$ Torr, the ionic current $i_2$ flows between the pressure detector electrodes 21 and 22 at a certain phase of the voltage v at a time $t_1$, and the ionic discharge current $i_2$ flows at every half wave, as shown in waveform C. As a result, the current $i_3$ flowing through the series connection member 30 of the voltage allotment elements becomes an asymmetrical one having components of $i_3=i_1+i_2$ and $i_3=i_1$ as shown at D. In this case, although the level change of the current $i_3$ is very small, the terminal voltage $v_l$ of the inductance 32 becomes a pulsatile voltage, as shown in waveform M, when the current flowing through the inductance 32 changes from $i_1$ to $i_1+i_2$ at the time $t_1$.

The peak value $v_p$ of the pulsatile voltage is, in principle, as follows:

$$V_p = L\frac{d}{dt}\,|i_1 + i_2|_{t=t1}$$

where L: value of the inductance 32, and $i_1+i_2$: current flowing through the inductance 32. The peak value $v_p$ becomes a value corresponding to the ionic current $i_2$ of the vacuum pressure detector element 20.

Accordingly, the pulse voltage $v_p$ exhibits a value corresponding to the pressure inside the sealed envelope 10 of the vacuum interrupter. The pressure can therefore be known by applying the voltage $v_p$ as an input signal to the vacuum pressure detector means 40.

Figure 5:
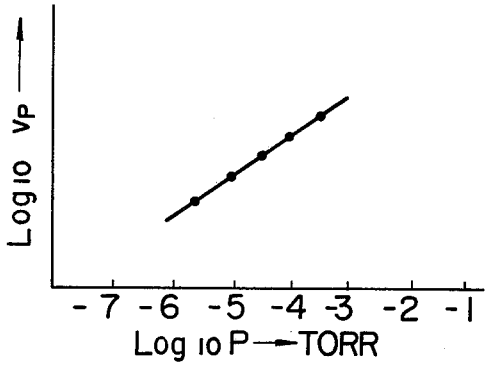
FIG. 5 is a characteristic diagram showing the relationship between the vacuum pressure of the vacuum interrupter in the apparatus of this invention and the input voltage signal of the vacuum pressure detector means.

FIG. 5 illustrates the relationship between the pressure P inside the sealed envelope 10 of the vacuum interrupter and the pulse voltage $v_p$, the relationship having been obtained by holding constant the intensities of the magnetic field and the electric field applied to the vacuum pressure detector element 20 and also holding the value of the inductance 32 constant. It has been found that the pulse voltage $v_p$ has a linear relation to the vacuum pressure P for the values of $10^{-5}-10^{-3}$ Torr.

Since the pulsatile voltage $v_p$ is applied to the vacuum pressure detector means 40 as an input voltage signal, a rise in the pressure of the sealed envelope 10 can be indicated by a suitable expedient, such as issuing an alarm when the voltage $v_p$ has reached a certain level.

According to the embodiment described above, the vacuum pressure detector element is mounted on a portion of the envelope of the vacuum interrupter which has the potential of the high voltage line to be interrupted thereby, one end of the pressure detector electrode being connected to the power supply side line, while the other end is connected to ground potential through the series connection member consisting of the voltage allotment elements formed by the resistance and the inductance in series. With this arrangement the voltage can be applied to the vacuum pressure detector element and the change of the ionic current with respect to time is converted to the pulsatile voltage across the inductance of the series connection member. Therefore, the pressure detector means 40 indicates the value of the internal pressure of the sealed envelope in accordance with the pulsatile voltage. Accordingly, a separate power supply for supplying voltage to the vacuum pressure detector element is not required, so that a vacuum interrupter having a pressure monitoring means which is low in cost and high in performance is obtained.

Different embodiments of this invention will now be described with reference to FIGS. 6 to 9.

All of these embodiments illustrate only the series connection member 30 and the vacuum pressure detector means 40, the remaining construction and the functions of the apparatus being the same as in FIG. 1. Hence, a detailed explanation thereof is omitted. The same symbols indicate the same or equivalent parts.

Figure 6:
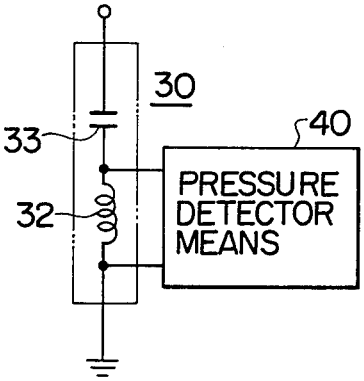
FIGS. 6 to 9 are schematic views showing vacuum pressure measuring circuits of respectively different embodiments of the apparatus of this invention.
Figure 7:
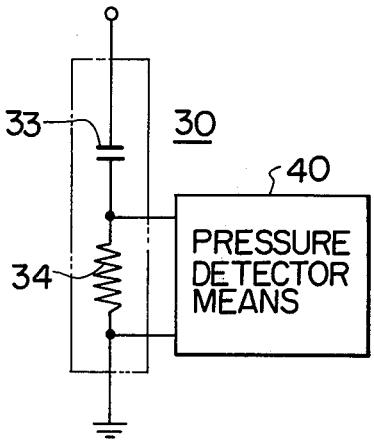

In the embodiment of FIG. 6, the series connection member 30 consists of a capacitor 33 and an inductance 32 connected in series. In the embodiment of FIG. 7, the capacitor 33 and a resistance 34 are connected in series. The capacitor 33 in the series connection member 30 in these embodiments exhibits a low impedance for a high frequency. (High frequency components are generated depending on the ionic current $i_2$ at time $t_1$, as shown in FIG. 4). Therefore, the voltage allotment ratio changes for a normal frequency at a normal running condition and the high frequency produced in correspondence with the current change at the time of operation of the vacuum pressure detector element, so that the input voltage signal level to the vaccum pressure detector 40 changes. Accordingly, the operation of the vacuum pressure detector element can be detected as in the embodiment of FIG. 1.

Figure 8:
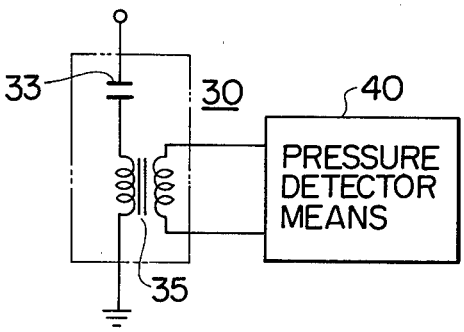

In the embodiment of FIG. 8, the series connection member 30 consists of the capacitor 33 and an insulating transformer 35 connected in series. According to this embodiment, besides the effects of the foregoing embodiments, the effect can be achieved that, since the vacuum pressure detector 40 can be perfectly isolated from the main circuit, the amount of insulation of the pressure detector 40 can be reduced.

Figure 9:
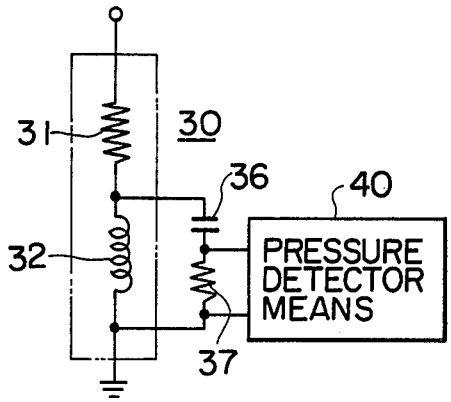

In the embodiment of FIG. 9, the series connection member 30 is constructed of the resistance 31 and the inductance 32 connected in series as in the embodiment of FIG. 1, and the input signal to the vacuum pressure detector means 40 is provided in the form of a current change obtained by branching the change of the terminal voltage of the inductance 32 to a series connection circuit consisting of a capacitor 36 and a resistance 37. Also, this embodiment can achieve the same effects as those of the embodiment of FIG. 1.

Further different embodiments of this invention will be described with reference to FIGS. 10 and 11.

In the previous embodiments, the method for applying the voltage to the vacuum pressure detector element consists in dividing the main circuit voltage between the stray capacity and the series connection member formed of the voltage allotment elements. In the embodiments of FIGS. 10 and 11, in order to maintain the divided voltage at a predetermined value, a nonlinear resistance 29 is connected in parallel with the stray capacitance between the pressure detector electrodes of the vacuum pressure detector element 20. The embodiment of FIG. 10 utilizes the electrostatic capacity of an insulator 38 as one constituent of the series connection member 30. A voltage of predetermined value is applied to the vacuum pressure detector element 20 owing to the combined impedance of the stray capacitance 28 and the nonlinear resistance 29, the capacitance of the insulator 38 constituting the series connection member 30, and the value of the inductance 32. Thus, the vacuum pressure detector means 40 is actuated. With this embodiment, the same effects as in the embodiment of FIG. 1 are achieved.

Figure 10:
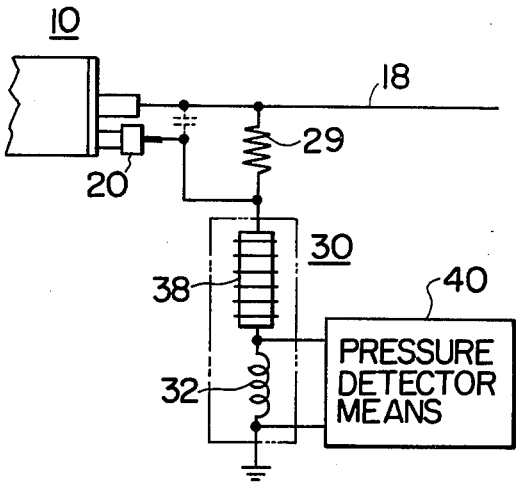
FIGS. 10 and 11 are schematic views each showing a further embodiment of this invention.
Figure 11:
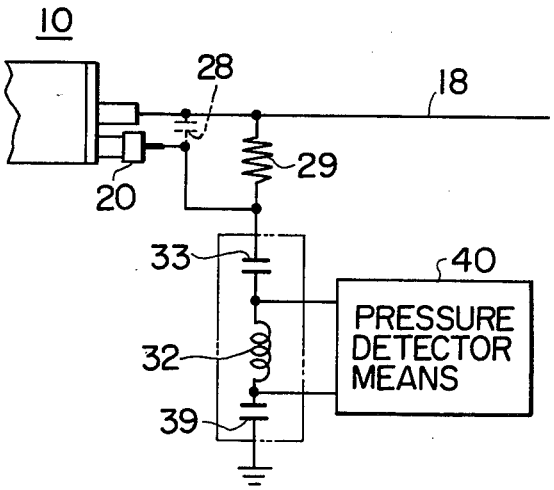

In the embodiment of FIG. 11, the nonlinear resistance 29 is provided as in the embodiment of FIG. 10. The series connection member 30 is constructed by connecting the first capacitor 33, the inductance 32 and a second capacitor 39 in series. In this case, the capacitance of the second capacitor 39 in the series connection member 30 is made larger than that of the first capacitor 33 and the terminal voltage of the second capacitor 39 can be made smaller, so that one terminal of the input voltage signal of the vacuum pressure detector means can be held substantially at ground potential. In consequence, according to this embodiment, the same effects as in FIG. 1 are achieved. In addition, since the vacuum pressure detector means can be insulated from the ground potential portion of the main circuit by the second capacitor 39, the electrical connection between the ground potential portion of the main circuit and ground in the circuit arrangement, not shown, of the vacuum pressure detector means 40 can be cut off. This brings forth the effect that noise signals from the ground potential portion of the main circuit to the vacuum pressure detector means 40 can be intercepted to ensure a stable operation.

The series connection member in the embodiments set forth above is constructed in such a way that at least two of the individual voltage allotment elements selected from a resistance, an inductance, and a capacitance are connected in series. However, the same effects are achieved in such a way that one unit is formed by connecting two or more different sorts of voltage allotment elements in parallel or in series and that at least one other voltage allotment element is connected in series with the unit.

As a modification of this invention, erroneous operation resulting from corona noises in the high voltage circuit can be prevented by disposing a filter, which is conformed to the frequency of the corona noises, as is well known, at the input terminals of the vacuum pressure detector means. Further, as a measure of preventing erroneous operation ascribable to a lightning surge voltage applied to the main circuit line or to a switching surge voltage during the switching operation of the interrupter, a well-known integration circuit is disposed at the input terminals of the vacuum pressure detector means. Since both the surge voltages are nonsustained ones, the surge voltages can be discriminated from the sustained pulse voltage occurring at the operation of the vacuum pressure detector element, as caused by the pressure rise of the envelope of the vacuum interrupter.

As apparent from the above description, according to this invention, the vacuum pressure detector element is mounted on a portion of the envelope having the same potential as that of the main power line, one end of the pressure detector electrode of the detector element being conductively connected to the main circuit line and at least two different sorts of voltage allotment elements selected from a resistance, an inductance and a capacitance being connected in series between the other end of the pressure detector electrode and ground potential. In this way, a suitable voltage is supplied to the vacuum pressure detector element for its operation, and besides, the vacuum pressure detector means for detecting the operation of the vacuum pressure detector element is connected in parallel with a part of the series connection consisting of the voltage allotment elements. It is therefore possible to provide a low-cost and high-performance vacuum interrupter with pressure monitoring means which does not require separate power supply means for bestowing the voltage on the vacuum pressure detector element and which can eliminate the influence of the stray capacitance in the circuit arrangement.

While we have shown and described several embodiments in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

What is claimed is:

1. A pressure monitoring arrangement for use with a vacuum interupter having an envelope evacuated to a predetermined degree of vacuum and a pair of separable electrodes arranged in said envelope for connection to a high voltage circuit, comprising a pair of vacuum pressure detector electrodes supported in spaced insulated relationship to each other in communication with the interior of said envelope, one of said detector electrodes being conductively connected to said high voltage circuit, a series connection member which consists of the series connection of at least two different voltage allotment elements selected from the group consisting of a resistance, an inductance and a capacitor and having a voltage allotment ratio varied in dependence on frequency, said series connection member being connected between the other one of said detector electrodes and ground potential, and vacuum pressure detector means connected in parallel with a part of said series connection member for detecting a voltage produced by a change of current flowing through said series connection member, whereby said voltage is detected as a measure of the pressure of said envelope.

2. A pressure monitoring arrangement according to claim 1, characterized in that said series connection member comprises a series connection consisting of a resistance and an inductance, and that said vacuum pressure detector means is connected in parallel with said inductance.

3. A pressure monitoring arrangement according to claim 1, characterized in that said series connection member comprises a series connection consisting of a capacitor and an inductance, and that said vacuum pressure detector means is connected in parallel with said inductance.

4. A pressure monitoring arrangement according to claim 1, characterized in that said series connection member comprises a series connection consisting of a capacitor and a resistance, and that said vacuum pressure detector means is connected in parallel with said resistance.

5. A pressure monitoring arrangement according to claim 1, further comprising an impedance connected between said other vacuum pressure detecting electrode to which said series connection member is connected and said high voltage circuit.

6. A pressure monitoring arrangement according to claim 5, characterized in that said impedance is a capacitor.

7. A pressure monitoring arrangement according to claim 5, characterized in that said impedance is a voltage-nonlinear resistance element.

8. A pressure monitoring arrangement according to claim 1, characterized in that said series connection member comprises a resistance and an inductance in series, further including a series combination of a capacitor and a second resistor connected across said inductor, said vacuum pressure detector means being connected in parallel with said second resistance.

9. A pressure monitoring arrangement according to claim 1, characterized in that said series connection member comprises a resistance connected in series with the primary winding of a transformer having a secondary winding connected to said vacuum pressure detector means.

10. A pressure monitoring arrangement according to claim 5, characterized in that said series connection member comprises a series connection consisting of a resistance and an inductance, and that said vacuum pressure detector means is connected in parallel with said inductance.

11. A pressure monitoring arrangement according to claim 5, characterized in that said series connection member comprises a series connection consisting of a capacitor and an inductance, and that said vacuum pressure detector means is connected in parallel with said inductance.

12. A pressure monitoring arrangement according to claim 11 wherein said series connection member further includes a second capacitor connected between said inductor and ground.

13. A pressure monitoring arrangement as defined in claim 1 wherein said pair of detector electrodes comprise a cylindrical electrode and a rod-shaped electrode concentrically disposed with said cylindrical electrode being connected to a conductive portion of said evacuated envelope which is in conductive relationship with one of said separable electrodes, said rod-shaped electrode being connected to said series connection member.

14. A pressure monitoring arrangement as defined in claim 13, further including magnetic field generating means for generating a magnetic field in the space between said detector electrodes.

* * * * *